US010239333B2

(12) United States Patent
Chiba

(10) Patent No.: US 10,239,333 B2
(45) Date of Patent: Mar. 26, 2019

(54) CUTTER, PRINTER, AND METHOD OF CONTROLLING CUTTER

(71) Applicant: FUJITSU COMPONENT LIMITED, Tokyo (JP)

(72) Inventor: Masafumi Chiba, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 361 days.

(21) Appl. No.: 14/633,213

(22) Filed: Feb. 27, 2015

(65) Prior Publication Data

US 2015/0258819 A1 Sep. 17, 2015

(30) Foreign Application Priority Data

Mar. 13, 2014 (JP) ..... 2014-050787

(51) Int. Cl.

| | |
|---|---|
| ***B41J 11/70*** | (2006.01) |
| ***B26D 1/08*** | (2006.01) |
| ***B26D 1/02*** | (2006.01) |
| ***B26D 1/06*** | (2006.01) |
| ***B26D 5/00*** | (2006.01) |
| ***B26D 5/08*** | (2006.01) |
| ***B41J 11/66*** | (2006.01) |
| *B26D 1/00* | (2006.01) |

(52) U.S. Cl.

CPC ..... *B41J 11/70* (2013.01); *B26D 1/025* (2013.01); *B26D 1/065* (2013.01); *B26D 1/085* (2013.01); *B26D 5/007* (2013.01); *B26D 5/08* (2013.01); *B41J 11/663* (2013.01); *B26D 5/00* (2013.01); *B26D 2001/0066* (2013.01); *Y10T 83/04* (2015.04); *Y10T 83/8827* (2015.04)

(58) Field of Classification Search

CPC . B26D 1/12; B26D 1/34; B26D 1/025; B26D 1/065; B26D 1/085; B41J 11/66; B41J 11/663; B41J 11/68; B41J 11/70; B41J 11/703; B41J 11/706

USPC ..... 83/610–612

See application file for complete search history.

(56) References Cited

U.S. PATENT DOCUMENTS 5,000,812 A * 3/1991 Murphy ..... B26D 1/626 156/268
5,377,572 A * 1/1995 Sonobe ..... B26D 1/0006 83/583
5,701,565 A * 12/1997 Morgan ..... G03G 15/757 399/167
5,746,527 A 5/1998 Nebashi et al.

(Continued)

FOREIGN PATENT DOCUMENTS

CN 1156669 8/1997
CN 101546440 9/2009

(Continued)

*Primary Examiner* — Jason Daniel Prone
*Assistant Examiner* — Richard D Crosby, Jr.
(74) *Attorney, Agent, or Firm* — IPUSA, PLLC

(57) ABSTRACT

A cutter includes a fixed blade, a movable blade, a drive motor that moves the movable blade, and a controller that drives the drive motor to move the movable blade toward the fixed blade and to cut a medium. The controller drives the drive motor such that output torque of the drive motor during a process other than a cutting process where the medium is cut becomes lower than the output torque of the drive motor during the cutting process.

9 Claims, 16 Drawing Sheets

(56) References Cited

U.S. PATENT DOCUMENTS 5,971,640 A * 10/1999 Brewington ..... B41J 11/70 400/621
6,164,854 A * 12/2000 Otsuki ..... B26D 1/305 318/256
6,405,625 B1 * 6/2002 Nomura ..... B41J 15/042 83/618
6,684,743 B1 * 2/2004 Brewington ..... B41J 11/66 100/288
8,522,660 B2 * 9/2013 Hayashi ..... B26D 5/20 270/58.04
8,894,306 B2 * 11/2014 Kosuge ..... B41J 11/666 400/621
8,911,168 B2 * 12/2014 Yoshinuma ..... B26D 1/185 400/621
2005/0178254 A1 * 8/2005 Ahne ..... B26D 5/00 83/13
2005/0186008 A1 * 8/2005 Imai ..... B41J 11/70 400/618
2008/0141838 A1 6/2008 Sussmeier et al.
2009/0211417 A1 * 8/2009 Rummel ..... B26D 5/00 83/74
2009/0245914 A1 10/2009 Shibasaki et al.
2011/0239839 A1 * 10/2011 Yoshida ..... B26D 1/085 83/79
2011/0280644 A1 * 11/2011 Toyoshima ..... B26D 1/205 400/621
2012/0219344 A1 8/2012 Kishi et al.
2012/0308289 A1 12/2012 Kosuge
2013/0202342 A1 8/2013 Kosuge et al.
2013/0271544 A1 * 10/2013 Yajima ..... B41J 11/70 347/104
2015/0217473 A1 * 8/2015 Chiba ..... B26D 1/385 83/74
2015/0298336 A1 * 10/2015 Pantonial ..... B26D 5/20 83/13
2015/0309464 A1 * 10/2015 Kubota ..... G03G 15/6582 399/407

FOREIGN PATENT DOCUMENTS

| | | |
|---|---|---|
| EP | 0764542 | 3/1997 |
| JP | H09-098599 | 4/1997 |
| JP | H9-238225 | 9/1997 |
| JP | 2003-300351 | 10/2003 |
| JP | 2006-136149 | 5/2006 |
| JP | 2012-171076 | 9/2012 |
| JP | 2012-250325 | 12/2012 |
| JP | 2012-254489 | 12/2012 |
| JP | 2013-158965 | 8/2013 |
| JP | 2013-158972 | 8/2013 |

* cited by examiner

CUTTER, PRINTER, AND METHOD OF CONTROLLING CUTTER

CROSS-REFERENCE TO RELATED APPLICATION

The present application is based upon and claims the benefit of priority of Japanese Patent Application No. 2014-050787, filed on Mar. 13, 2014, the entire contents of which are incorporated herein by reference.

BACKGROUND OF THE INVENTION

1. Field of the Invention

An aspect of this disclosure relates to a cutter, a printer, and a method of controlling the cutter.

2. Description of the Related Art

Printers for printing receipts are widely used, for example, for cash registers in shops and stores, and for automated teller machines (ATM) and cash dispensers (CD) in banks. In a printer for printing receipts, for example, information is printed by a thermal head on recording paper (thermal paper) while the recording paper is being fed, and the recording paper is cut with a cutter at a predetermined length, i.e., after the predetermined length of the recording paper is fed.

Such a cutter includes a fixed blade and a movable blade. The movable blade moves toward the fixed blade to cut recording paper sandwiched between the fixed blade and the movable blade.

To cut a recording medium such as recording paper with the cutter, the movable blade is moved by rotating a drive motor for driving the movable blade. When a stepping motor is used as the drive motor for driving the movable blade, the stepping motor is rotated at a constant frequency and with a constant electric current (see, for example, Japanese Laid-Open Patent Publication No. 2012-250325 and Japanese Laid-Open Patent Publication No. 2012-254489).

In a case of a small printer driven by a battery, it is desired to reduce power consumed by the printer. Accordingly, it is also preferable to reduce power consumed by a cutter of the printer as far as possible.

SUMMARY OF THE INVENTION

In an aspect of this disclosure, there is provided a cutter that includes a fixed blade, a movable blade, a drive motor that moves the movable blade, and a controller that drives the drive motor to move the movable blade toward the fixed blade and to cut a medium. The controller drives the drive motor such that output torque of the drive motor during a process other than a cutting process where the medium is cut becomes lower than the output torque of the drive motor during the cutting process.

DESCRIPTION OF EMBODIMENTS

Embodiments of the present invention are described below with reference to the accompanying drawings. The same reference number is assigned to the same component throughout the accompanying drawings, and repeated descriptions of the same component are omitted.

«First Embodiment»

An aspect of this disclosure makes it possible to reduce a cutting time and a cutting load. The cutting load can be reduced by decreasing a cutting speed. Assuming that a force generated when a cutter collides with paper is expressed by F=Ma and the speed of the cutter decreases to a certain speed when the cutter collides with paper, the force is proportional to a moving speed of the cutter before the collision. Accordingly, decreasing the cutting speed makes it possible to decrease the cutting load, reduce the abrasion of blades, lengthen the life of the blades, and reduce an output torque. On the other hand, decreasing the overall cutting speed results in a longer cutting time. An aspect of this disclosure makes it possible to reduce the total cutting time as well as the cutting load.

First, a cutting load of a cutter to cut a medium such as recording paper is described with reference to FIG. 1.

Figure 1:
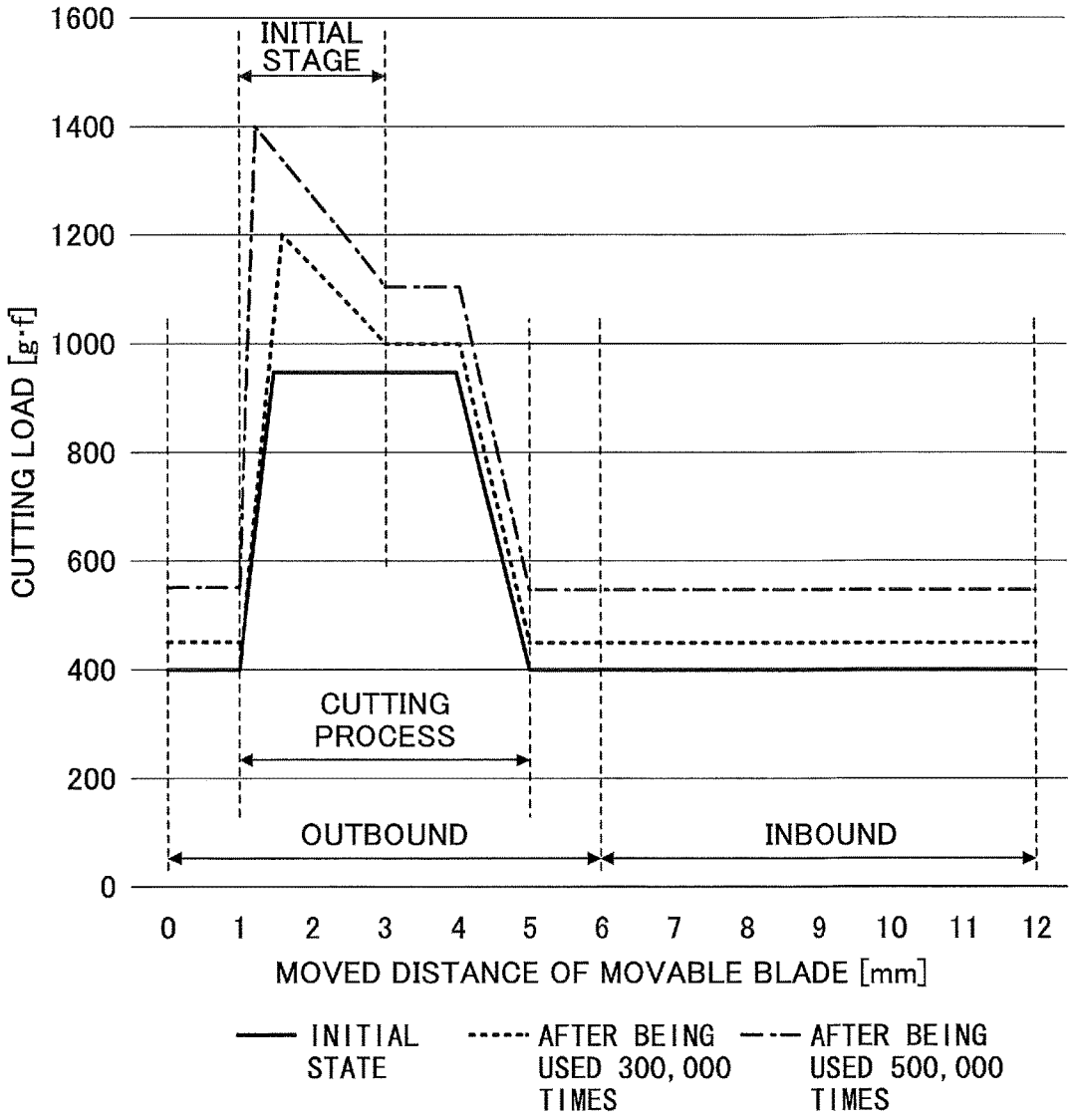
FIG. 1 is a graph illustrating a cutting load of a cutter.

FIG. 1 is a graph illustrating a relationship between a moving distance of a movable blade of a cutter and a cutting load of the cutter to cut the medium, for each of cases where the cutter is in an initial state, in a state after being used 300,000 times to cut the medium, and in a state after being used 500,000 times to cut the medium.

In FIG. 1, when the moving distance is 0 mm, the movable blade is at a home position. When the moving distance is between 0 mm and 6 mm, the movable blade is moving in a direction toward a fixed blade (outbound direction). When the moving distance (the total moving distance from the home position) is between 6 mm and 12 mm, the movable blade is moving away from the fixed blade (inbound direction). When the moving distance is 12 mm, the movable blade is returning at the home position. Thus, the movable blade moves 12 mm in one round trip. The movable blade moves in opposite directions in a moving distance range between 0 mm and 6 mm and in a moving distance range between 6 mm and 12 mm. The moving direction of the movable blade is reversed at a moving distance of 6 mm.

In FIG. 1, a cutting process corresponds to a time period from when the movable blade contacts the medium to when the cutting of the medium is completed. As illustrated in FIG. 1, the cutting process corresponds to a moving distance range between 1 mm and 5 mm. An initial stage in FIG. 1 indicates the beginning of the cutting process and corresponds to a time period from when the cutting process is started to when the movable blade moves a predetermined distance. In the example of FIG. 1, the initial stage corresponds to a time period during which the movable blade moves from the home position to a position that is 3 mm from the home position, i.e., a time period from when the cutting process is started to when the cutting load becomes constant. The remaining time period (or a time period after the initial stage) in the cutting process may be referred to as a "later stage". A moving distance range between 0 mm and 1 mm and a moving distance range between 5 mm and 12 mm correspond to processes other than the cutting process in which the cutter is not cutting the medium. The cutting load during the cutting process is higher than the cutting load during processes other than the cutting process because the movable blade is in contact with the medium.

When a cutter is in an initial state, i.e., the cutter has not been used many times to cut the medium, the cutting load during the cutting process is substantially uniform at about 950 g·f. The cutting load gradually increases as the number of times the cutter is used to cut the medium (which is hereafter referred to as a "medium cutting count") increases. The increase in the cutting load is due to the abrasion of the edge of the movable blade, which results from repeated cutting of the medium. Particularly, the cutting load in the initial stage increases drastically.

As illustrated by FIG. 1, when the medium cutting count reaches 300,000 (i.e., after the cutter is used to cut a medium 300,000 times), the maximum cutting load in the initial stage becomes about 1,200 g·f, the cutting load after the initial stage becomes about 1,000 g·f, and the cutting load after the cutting process becomes about 450 g·f. When the medium cutting count reaches 500,000 (i.e., after the cutter is used to cut a medium 500,000 times) and the abrasion of the blade edge further proceeds, the maximum cutting load in the initial stage becomes about 1,400 g·f, the cutting load after the initial stage becomes about 1,000 g·f, and the cutting load after the cutting process becomes about 550 g·f.

When a medium cutting count of 500,000 is the life of a cutter, the frequency and the electric current for driving a stepping motor used as a drive motor are set such that the torque of the drive motor becomes 1,400 g·f. As described above, a drive motor for driving a movable blade is generally driven at a constant frequency and with a constant electric current. Therefore, the movable blade is driven at high torque even in the initial stage of the cutting process and during processes other than the cutting process.

The torque of a drive motor can be increased by increasing the electric current flowing into the drive motor or by lowering the drive frequency for driving the drive motor. However, when the drive frequency is entirely lowered to increase the torque of the drive motor, the speed of movement of the movable blade decreases and the time necessary to cut a medium increases. Accordingly, this approach does not meet the demand of a user who desires to cut a medium quickly. Also, when the electric current flowing into the drive motor is entirely increase, the power consumption of the drive motor increases. Accordingly, this approach does not meet a demand to reduce power consumed by a printer.

For the above reasons, a cutter that can quickly cut a medium and consumes less power is desired.

<Cutter>

Figure 2:
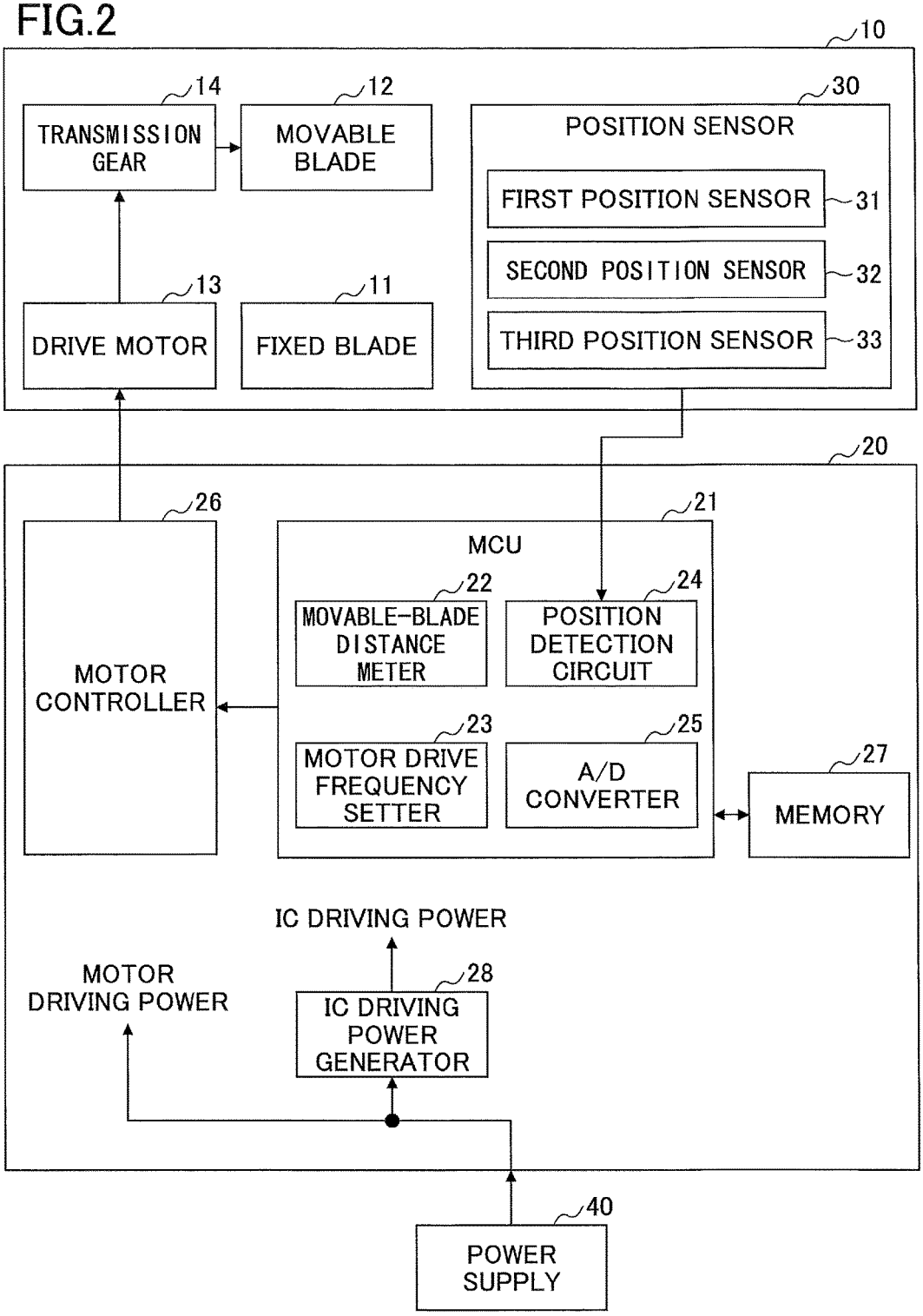
FIG. 2 is a block diagram illustrating an exemplary configuration of a cutter according to an embodiment.
Figure 3:
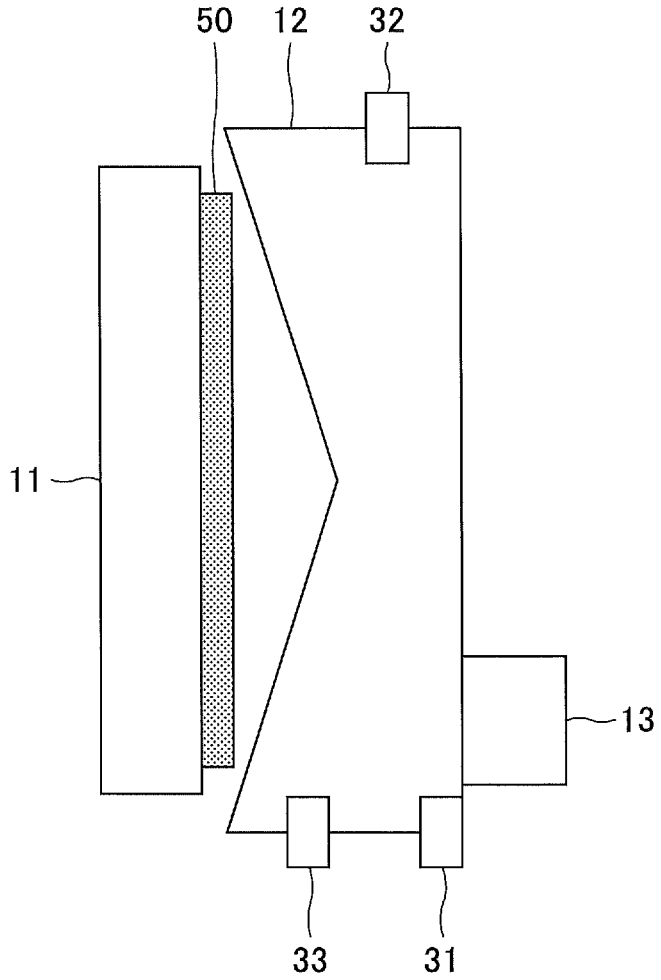
FIG. 3 is a schematic diagram of a cutting mechanism of a cutter according to an embodiment.

A cutter according to an embodiment is described below with reference to FIGS. 2 and 3. FIG. 2 is a block diagram illustrating an exemplary configuration of a cutter of the present embodiment, and FIG. 3 is a schematic diagram of a cutting mechanism 10 of the cutter. The cutter of the present embodiment is to be connected to or installed in a printer, and cuts a medium 50 on which information is printed by the printer. The cutter of the present embodiment includes the cutter mechanism 10 and a control circuit 20. The cutter mechanism 10 includes a fixed blade 11, a movable blade 12, a drive motor 13, a transmission gear 14, and a position sensor 30. The drive motor 13 is implemented by a stepping motor.

The control circuit 20 includes a micro control unit (MCU) 21, a motor controller 26, a memory 27, and an integrated circuit (IC) driving power generator 28, and is connected to a power supply 40. The motor controller 26 controls the rotational speed and torque of the drive motor 13. The motor controller 26 sets a motor drive frequency and a drive current of the drive motor 13 such that the drive motor 13 achieves a predetermined rotational speed and predetermined torque. The IC driving power generator 28 converts, for example, the voltage of power supplied from the power supply 40 to generate IC driving power for driving an IC provided in the cutter.

The MCU 21 includes a movable-blade distance meter 22, a motor drive frequency setter 23, a position detection circuit 24, and an A/D converter 25. The movable-blade distance meter 22 counts the number of pulses for rotating the drive motor 13 and measures the distance that the movable blade 12 moves. The motor drive frequency setter 23 sets a motor drive frequency for driving the drive motor 13. The rotational speed of the drive motor 13 can be increased by increasing the motor drive frequency. The position detection circuit 24 detects the position of the movable blade 12 based on information detected by the position sensor 30. The A/D converter 25 converts an analog signal into a digital signal.

In the cutter mechanism 10, the rotation of the drive motor 13 is transmitted via the transmission gear 14 to the movable blade 14 to cause the movable blade 14 to slide (or move). When the movable blade 12 is slid toward the fixed blade 11, the medium 50 is cut by the movable blade 12 and the fixed blade 11. In the present embodiment, the position sensor 30 includes a first position sensor 31, a second position sensor 32, and a third position sensor 33. As illustrated by FIG. 3, the first position sensor 31, the second position sensor 32, and the third position sensor 33 are used to detect positions of the movable blade 12.

The first position sensor 31 detects whether the movable blade 12 is at a home position. The second position sensor 32 detects whether the movable blade 12 is at a position from which the movable blade 12 starts to cut the medium 50 (a start position of a cutting process) or at a position at which the cutting process ends (an end position of the cutting process). The third position sensor 33 detects whether the movable blade 12 is at a position at which the movable blade 12 finishes cutting the medium 50. The first position sensor 31, the second position sensor 32, and the third position sensor 33 are placed at predetermined positions to be able to detect the above described positions of the movable blade 12. The first position sensor 31, the second position sensor 32, and the third position sensor 33 may be implemented, for example, by optical position sensors.

Figure 4:
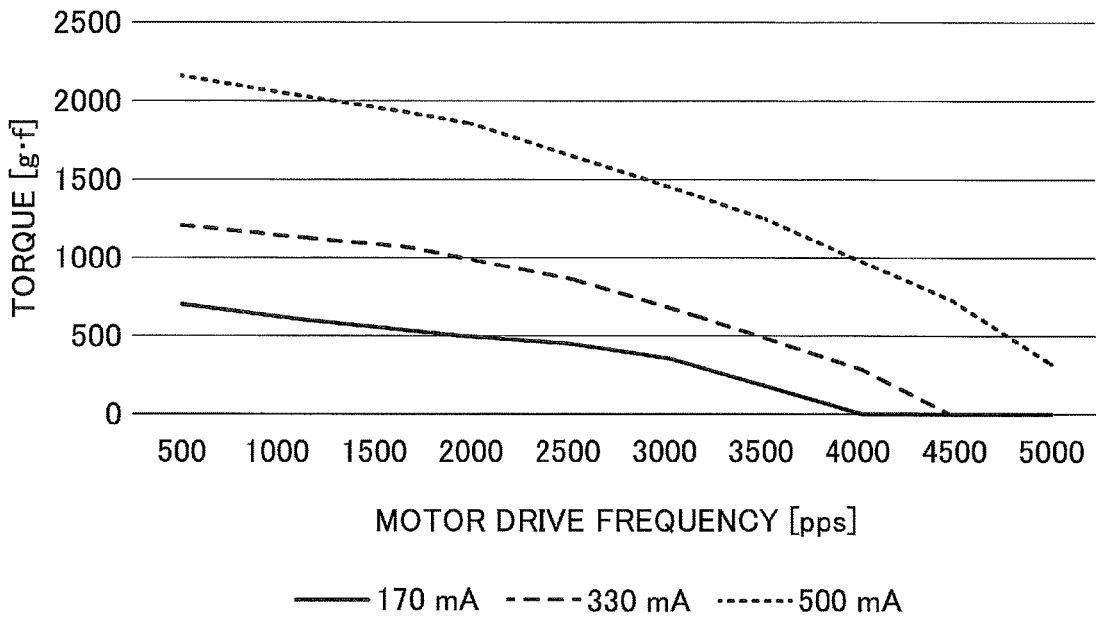
FIG. 4 is a graph illustrating a relationship between a motor drive frequency and torque of a drive motor.

Next, the drive motor 13 of the cutter of the present embodiment is described. As described above, the drive motor 13 is implemented by a stepping motor and has characteristics as illustrated by FIG. 4. FIG. 4 is a graph illustrating a relationship between a motor drive frequency and torque of the drive motor 13 for each of cases where a motor drive current for driving the drive motor 13 is 170 mA, 330 mA, and 500 mA, respectively. As illustrated by FIG. 4, the torque of the drive motor 13 decreases as the motor drive frequency increases, and the torque of the drive motor 13 increases as the motor drive current increases.

<Method of Controlling Cutter>

Figure 5:
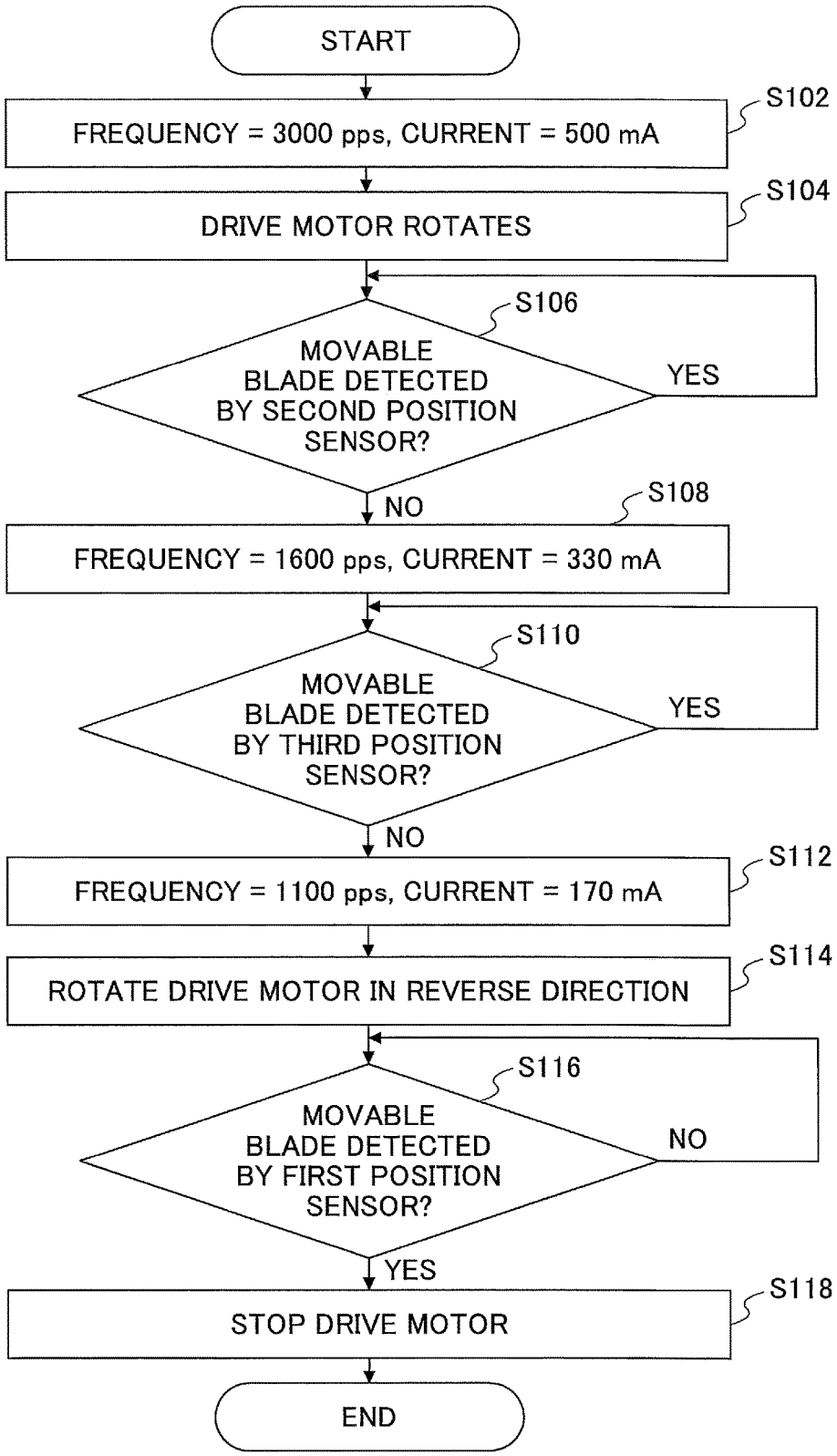
FIG. 5 is a flowchart illustrating a method of controlling a cutter according to a first embodiment.

Next, an exemplary method of controlling the cutter according to the present embodiment is described with reference to FIG. 5. In the present embodiment, the cutter is controlled by controlling an electric current supplied to the drive motor 13 and a motor drive frequency.

At step S102, the motor controller 26 sets the motor drive frequency at 3,000 pps and sets the drive current at 500 mA to drive the drive motor 13. As a result, at step S104, the drive motor 13 rotates and the movable blade 12 slides toward the fixed blade 11. The conditions for driving the drive motor 13 are set at the above described values because the cutting load in the initial stage of the cutting process becomes high as illustrated in FIG. 1 when the cutter is repeatedly used to cut the medium 50. More specifically, these conditions are determined based on a graph of FIG. 8 such that torque corresponding to a peak cutting load of 1,400 g·f, which is observed when the medium cutting count is 500,000, can be obtained by the drive motor 13.

Figure 6A:
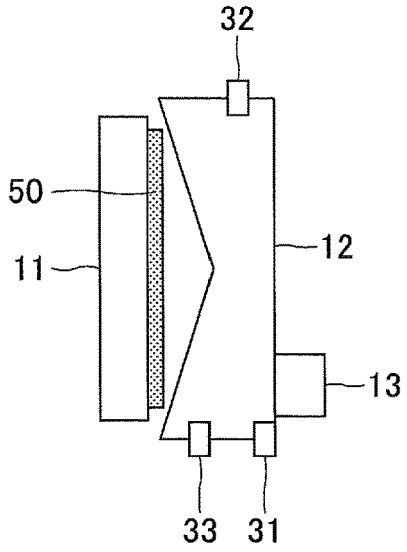
FIGS. 6A through 6C are drawings used to describe a method of controlling a cutter according to the first embodiment.

Before the drive motor 13 rotates, as illustrated by FIG. 6A, the movable blade 12 is at a position where the movable blade 12 is detectable by all of the first position sensor 31, the second position sensor 32, and the third position sensor 33. After that, the movable blade 12 moves toward the fixed blade 11 and becomes undetectable by the first position sensor 31. Then, the movable blade 12 moves further toward the fixed blade 11.

Figure 8:
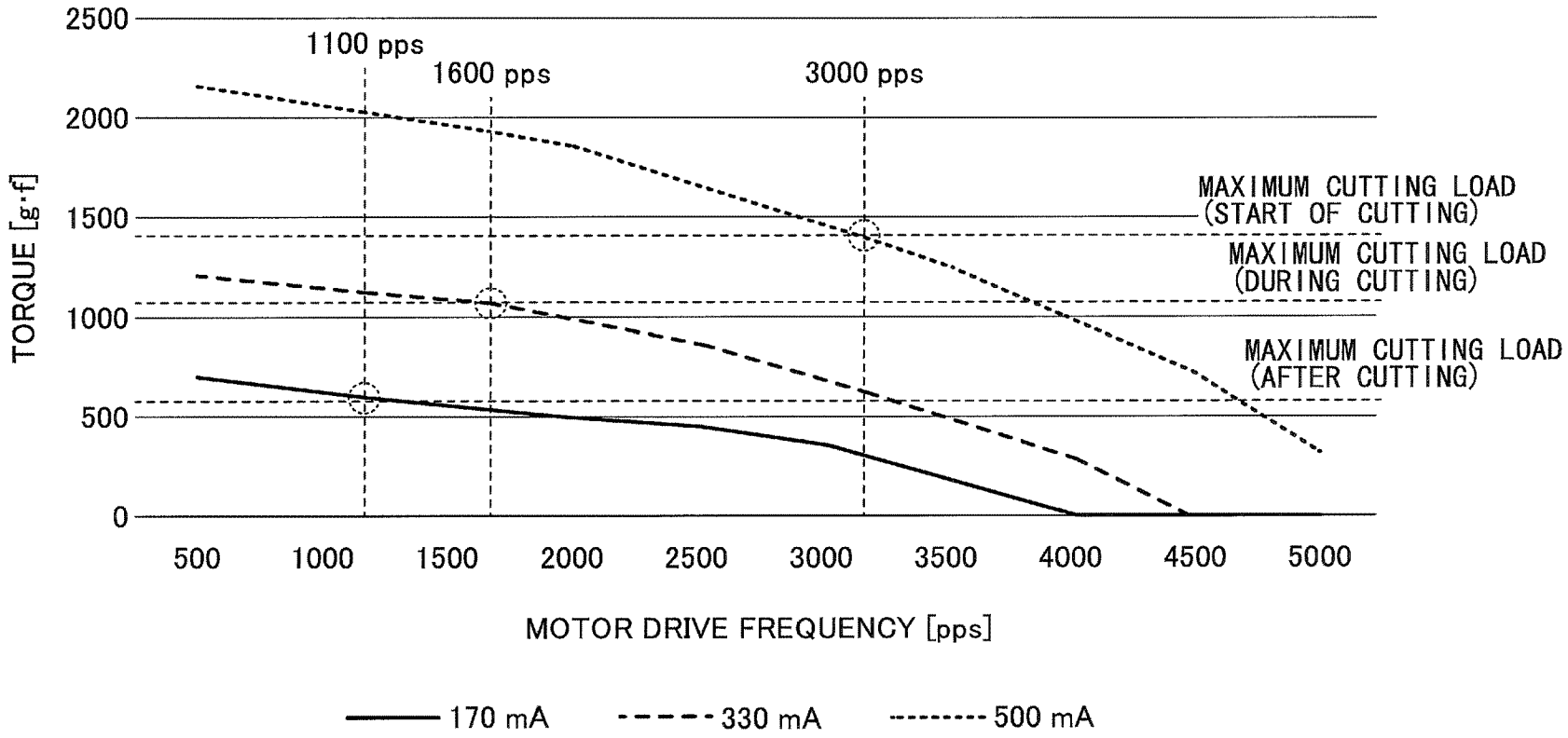
FIG. 8 is a graph illustrating a relationship between a motor drive frequency and torque of a drive motor.

In the present embodiment, the drive motor 13 is driven at 3,000 pps and 500 mA to be able to obtain torque of 1,400 g·f that is necessary in the initial stage of the cutting process when the medium cutting count of the cutter is 500,000 (see FIG. 8 "START OF CUTTING"). In the middle of the cutting process, the drive motor 13 is driven at 3,700 pps and 500 mA or at 1,600 pps and 330 mA to obtain torque of 1,100 g·f (see FIG. 8 "DURING CUTTING"). In the present embodiment, the drive motor 13 is driven at 1,600 pps and 330 mA that require less driving power and cause the movable blade 12 to move at a slower speed. When priority is given to the moving speed of the movable blade 12, the drive motor 13 may be driven at 3,700 pps and 500 mA. After the cutting process, the drive motor 13 is driven at 4,700 pps and 500 mA, 3,400 pps and 330 mA, or 1,100 pps and 170 mA to obtain torque of 550 g·f (see FIG. 8 "AFTER CUTTING"). In the present embodiment, the drive motor 13 is driven at 1,100 pps and 170 mA that require less driving power.

Figure 6B:
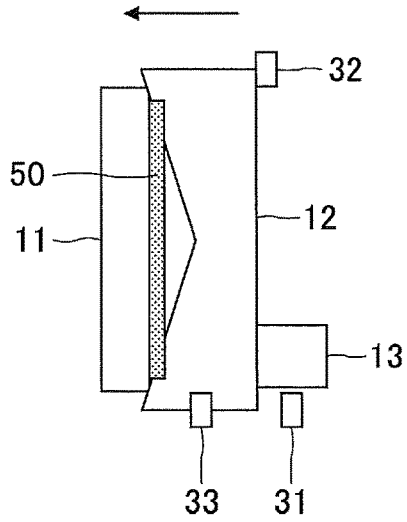

At step S106, the motor controller 26 determines whether the movable blade 12 is detected by the second position sensor 32. When the second position sensor 32 is detecting the movable blade 12, the motor controller 26 repeats step S106. When the movable blade 12 is not detected by the second position sensor 32, the motor controller 26 proceeds to step S108. The case where the movable blade 12 is undetectable by the second position sensor 32 corresponds to a state illustrated by FIG. 6B where the cutting of the medium 50 has been started, i.e., the start of the cutting process.

At step S108, the motor controller 26 sets the motor drive frequency at 1,600 pps and sets the drive current at 330 mA to rotate the drive motor 13. As a result, the torque of the drive motor 13 decreases and the power consumption of the drive motor 13 also decreases. At step S108, the conditions for driving the drive motor 13 are set at the above described values to obtain torque corresponding to a cutting load of 1,100 g·f that is observed after the initial stage of the cutting process when the medium cutting count is 500,000 as illustrated in FIG. 1. More specifically, these conditions are determined based on the graph of FIG. 8. Here, a certain period of time is necessary before the process proceeds from step S106 to step S108. Therefore, if the initial stage is not completed before driving the drive motor 13 with the conditions set at step S108, a time lag may be set between step S106 and step S108.

Figure 6C:
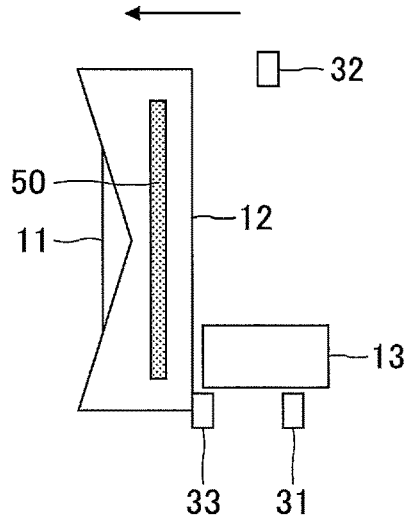

Next, at step S110, the motor controller 26 determines whether the third position sensor 33 is detecting the movable blade 12. When the third position sensor 33 is detecting the movable blade, the motor controller 26 repeats step S110. When the movable blade 12 is undetectable by the third position sensor 33, the motor controller 26 proceeds to step S112. The case where the movable blade 12 is undetectable by the third position sensor 33 corresponds to a state illustrated by FIG. 6C where the cutting of the medium 50 has been completed, i.e., the end of the cutting process.

At step S112, the motor controller 26 sets the motor drive frequency at 1,100 pps and sets the drive current at 170 mA. As a result, the torque of the drive motor 13 further decreases and the power consumption of the drive motor 13 also further decreases. At step S112, the conditions for driving the drive motor 13 are set at the above described values to obtain torque corresponding to a cutting load of 550 g·f that is observed during a process other than the cutting process when the medium cutting count is 500,000 as illustrated in FIG. 1. More specifically, these conditions are determined based on the graph of FIG. 8.

At step S114, the motor controller 26 rotates the drive motor 13 in a reverse direction at the motor drive frequency of 1,100 pps and with the drive current of 170 mA set at step S112. As a result, the movable blade 12 moves away from the fixed blade 11.

Figure 7A:
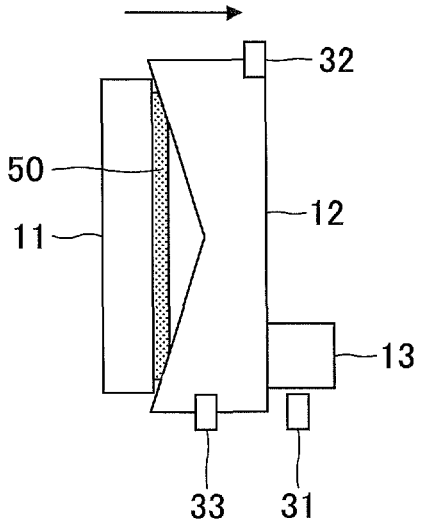
FIGS. 7A and 7B are drawings used to describe a method of controlling a cutter according to the first embodiment.
Figure 7B:
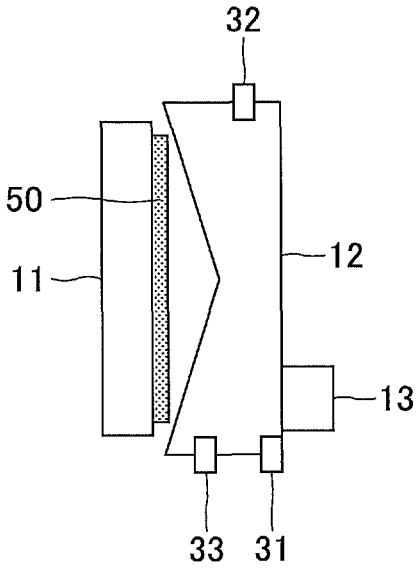

At step S116, the motor controller 26 determines whether the movable blade 12 is detected by the first position sensor 31. When the movable blade 12 is undetectable by the first position sensor 31, the motor controller 26 repeats step S116. When the movable blade 12 is detected by the first position sensor 31, the motor controller 26 proceeds to step S118. When the movable blade 12 is detected by the first position sensor 31, the movable blade 12 is at the home position as illustrated by FIG. 7B. The movable blade 12 moving away from the fixed blade 11 is detected by the third position sensor 33 and the second position sensor 32 as illustrated by FIG. 7A, and then reaches the home position as illustrated by FIG. 7B.

At step S118, the motor controller 26 stops the rotation of the drive motor 13 to end the process of controlling the cutter of the present embodiment.

<Printer>

Figure 9:
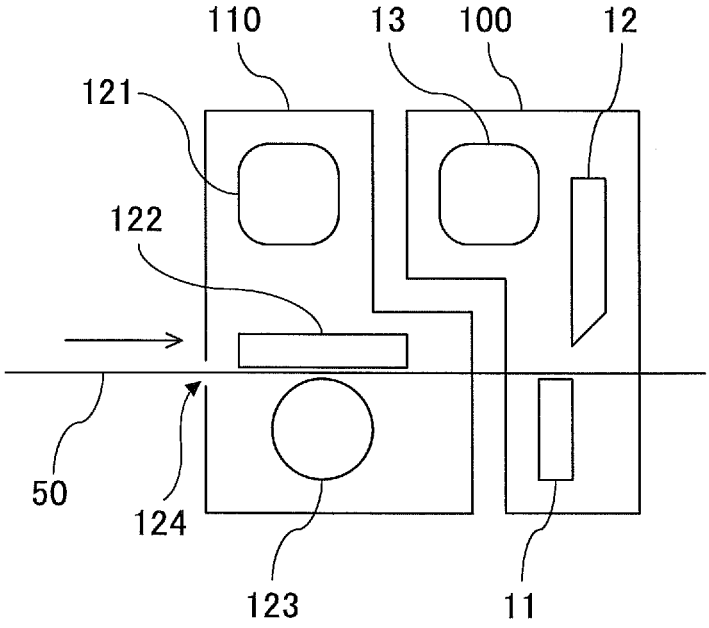
FIG. 9 is a schematic diagram of a printer according to an embodiment.

Next, a printer using the cutter of the present embodiment is described. The printer of the present embodiment is configured to print information on the medium 50, and includes a printer body 110 as illustrated by FIG. 9. A cutter 100 is connected to the printer body 110. The printer body 110 includes a motor 121 for feeding the medium 50, a thermal head 122 used as a print head for printing information on the medium 50, and a platen roller 123. As indicated by an arrow in FIG. 9, the medium 50 is inserted into the printer body 110 from a port 124. The cutter 100 is implemented by the cutter of the present embodiment, and cuts the medium 50 at a predetermined position.

«Second Embodiment»

Figure 10:
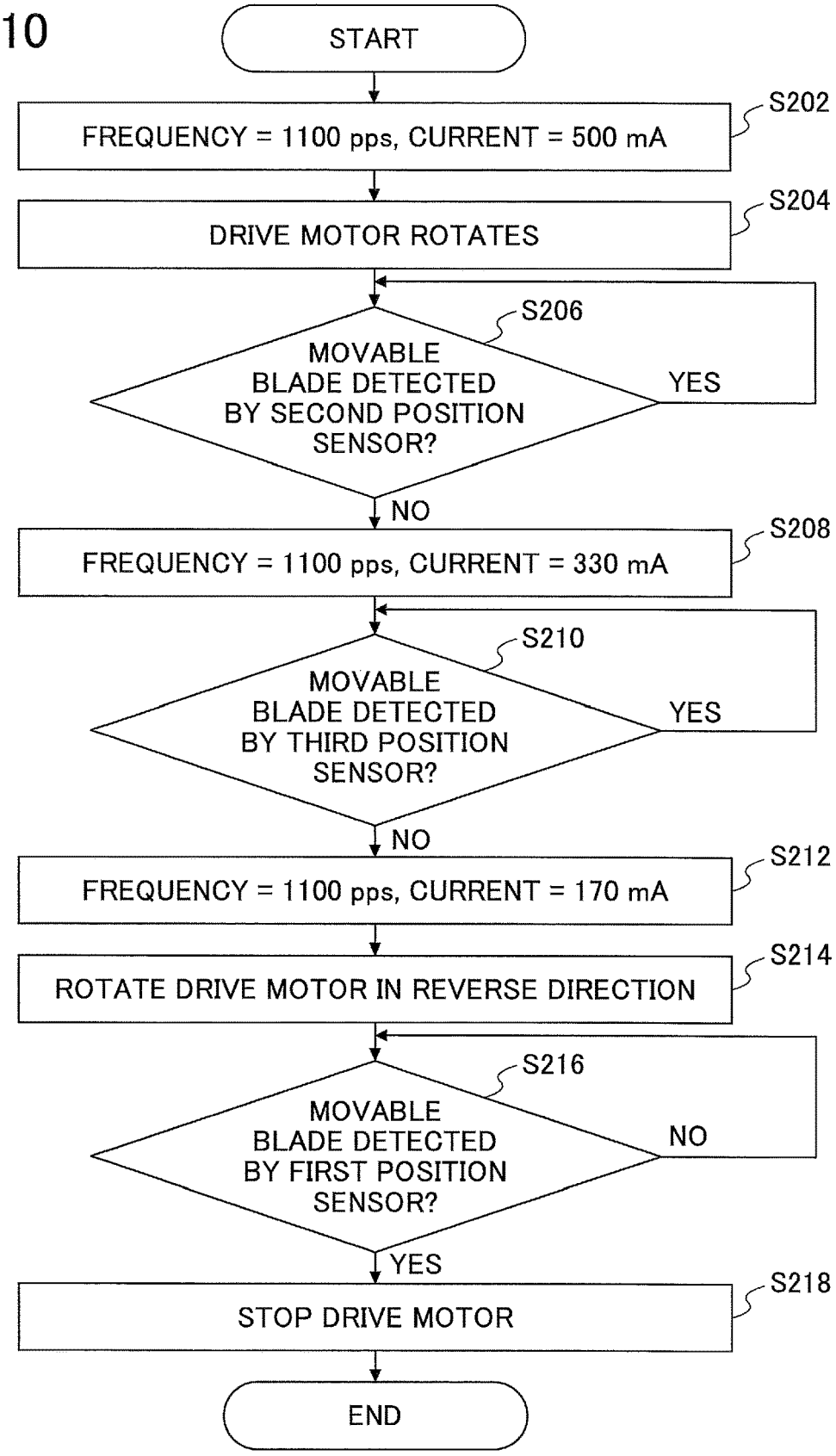
FIG. 10 is a flowchart illustrating a method of controlling a cutter according to a second embodiment.

Next, a second embodiment is described. In the second embodiment, the cutter is controlled by controlling the drive current supplied to the drive motor 13 while maintaining the motor drive frequency at a constant value. An exemplary method of controlling the cutter according to the present embodiment is described with reference to FIG. 10. In the present embodiment, the motor drive frequency is set at 1,100 pps.

Figure 11:
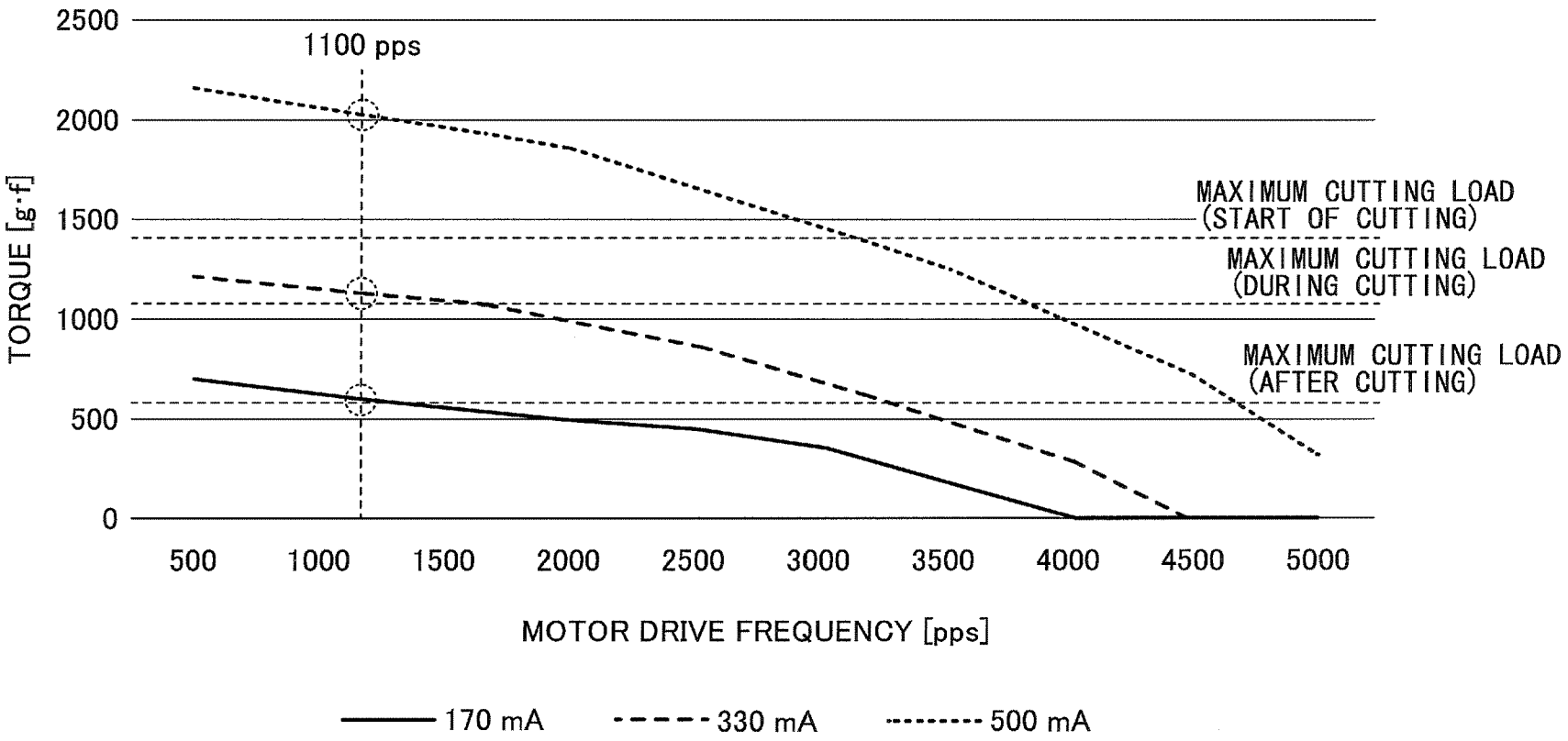
FIG. 11 is a graph illustrating a relationship between a motor drive frequency and torque of a drive motor.

At step S202, the motor controller 26 sets the drive current at 500 mA to drive the drive motor 13. As a result, at step 5204, the drive motor 13 rotates and the movable blade 12 slides toward the fixed blade 11. At step S202, the condition for driving the drive motor 13 is set at the above described value to obtain torque greater than or equal to 1,400 g·f. This condition is determined based on a graph of FIG. 11. FIG. 11 is a graph illustrating relationships between drive currents and torque when the motor drive frequency is set at 1,100 pps. To obtain torque of 1,400 g·f necessary in the initial stage of the cutting process, the drive motor 13 is driven with a drive current of 500 mA. To obtain torque of 1,100 g·f, the drive motor 13 is driven with a drive current of 330 mA. To obtain torque of 550 g·f, the drive motor 13 is driven with a drive current of 170 mA.

Before the drive motor 13 rotates, the movable blade 12 is at a position where the movable blade 12 is detectable by all of the first position sensor 31, the second position sensor 32, and the third position sensor as illustrated by FIG. 6A. After that, the movable blade 12 moves toward the fixed blade 11 and becomes undetectable by the first position sensor 31.

At step S206, the motor controller 26 determines whether the second position sensor 32 is detecting the movable blade 12. When the movable blade 12 is detected by the second position sensor 32, the motor controller 26 repeats step S206. When the movable blade 12 is undetectable by the second position sensor 32, the motor controller 26 proceeds to step S208. The case where the movable blade 12 is undetectable by the second position sensor 32 corresponds to a state illustrated by FIG. 6B where the movable blade 12 has started cutting the medium 50.

At step S208, the motor controller 26 sets the drive current at 330 mA to rotate the drive motor 13. As a result, the torque of the drive motor 13 decreases and the power consumption of the drive motor 13 also decreases. At step S208, the condition for driving the drive motor 13 is set at the above described value to obtain torque greater than or equal to 1,100 g·f. This condition is determined based on the graph of FIG. 11. Here, a certain period of time is necessary before the process proceeds from step S206 to step S208. Therefore, if the initial stage is not completed before driving the drive motor 13 with the conditions set at step S208, a time lag may be set between step S206 and step S208.

At step S210, the motor controller 26 determines whether the movable blade 12 is detectable by the third position sensor 33. When the movable blade 12 is detectable by the third position sensor 33, the motor controller 26 repeats step S210. When the movable blade 12 is undetectable by the third position sensor 33, the motor controller 26 proceeds to step S212. The case where the movable blade 12 is undetectable by the third position sensor 33 corresponds to a state illustrated by FIG. 6C where the cutting of the medium 50 has been completed.

At step S212, the motor controller 26 sets the drive current at 170 mA. As a result, the torque of the drive motor 13 further decreases and the power consumption of the drive motor 13 also further decreases. At step S212, the condition for driving the drive motor 13 is set at the above described value to obtain torque corresponding to a cutting load of 550 g·f illustrated in FIG. 1. More specifically, this condition is determined based on the graph of FIG. 11. At step S214, the motor controller 214 rotates the drive motor 13 in a reverse direction with the condition set at step S212. More specifically, the motor controller 214 rotates the drive motor 13 in the reverse direction at the motor drive frequency of 1,100 pps and with the drive current of 170 mA. As a result, the movable blade 12 moves away from the fixed blade 11.

At step S216, the motor controller 26 determines whether the movable blade 12 is detectable by the first position sensor 31. When the movable blade 12 is undetectable by the first position sensor 31, the motor controller 26 repeats step S216. When the movable blade 12 is detectable by the first position sensor 31, the motor controller 26 proceeds to step S218. When the movable blade 12 is detectable by the first position sensor 31, the movable blade 12 is at the home position as illustrated by FIG. 7B.

At step S218, the motor controller 26 stops the rotation of the drive motor 13 to end the process of controlling the cutter of the present embodiment.

Other details of the method of the second embodiment not described above are substantially the same as those of the first embodiment.

«Third Embodiment»

Figure 12:
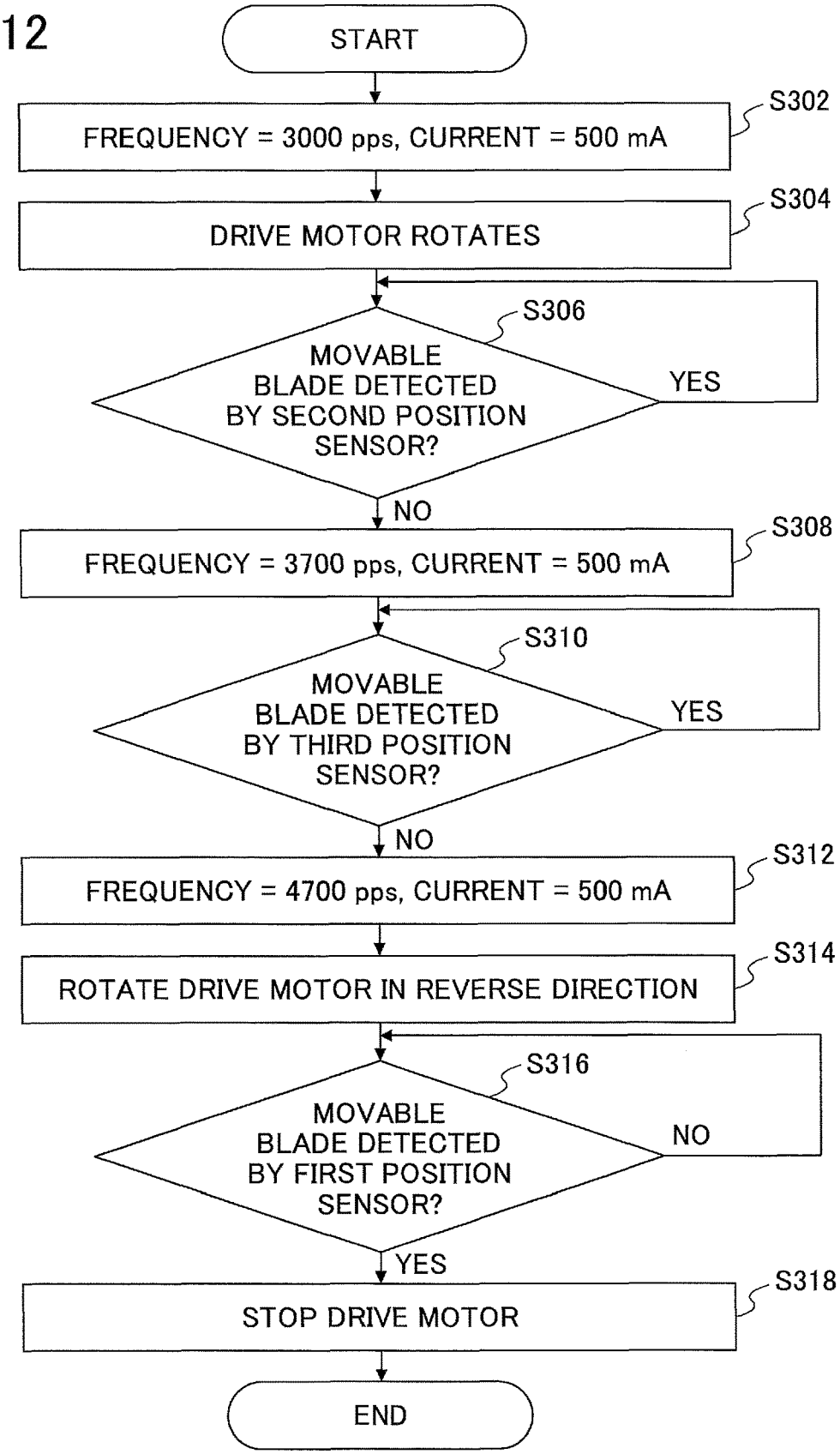
FIG. 12 is a flowchart illustrating a method of controlling a cutter according to a third embodiment.

Next, a third embodiment is described. In the third embodiment, the cutter is controlled by controlling the motor drive frequency for driving the drive motor 13 while maintaining the drive current supplied to the drive motor 13 at a constant value. An exemplary method of controlling the cutter according to the present embodiment is described with reference to FIG. 12. In the present embodiment, the drive current is set at 500 mA.

At step S302, the motor controller 26 sets the motor drive frequency at 3,000 pps to drive the drive motor 13. As a result, at step S304, the drive motor 13 rotates and the movable blade 12 slides (or moves) toward the fixed blade 11.

At step S302, the condition for driving the drive motor 13 is set at the above described value to obtain torque corresponding to a peak cutting load of 1,400 g·f, which is observed as illustrated in FIG. 1 when the medium cutting count is 500,000, can be obtained by the drive motor 13. This condition is determined based on a graph of FIG. 13.

At step S306, the motor controller 26 determines whether the movable blade 12 is detectable by the second position sensor 32. When the movable blade 12 is detectable by the second position sensor 32, the motor controller 26 repeats step S306. When the movable blade 12 is undetectable by the second position sensor 32, the motor controller 26 proceeds to step S308. The case where the movable blade 12 is undetectable by the second position sensor 32 corresponds to a state illustrated by FIG. 6B where the cutting of the medium 50 has been started.

At step S308, the motor controller 26 sets the motor drive frequency at 3,700 pps and sets the drive current at 550 mA to rotate the drive motor 13. As a result, the torque of the drive motor 13 decreases but the rotational speed of the drive motor 13 increases. This makes it possible to move the movable blade 12 at a higher speed. At step S308, the conditions for driving the drive motor 13 are set at the above described values to obtain torque corresponding to a cutting load of 1,100 g·f illustrated in FIG. 1. More specifically, these conditions are determined based on the graph of FIG. 13.

Figure 13:
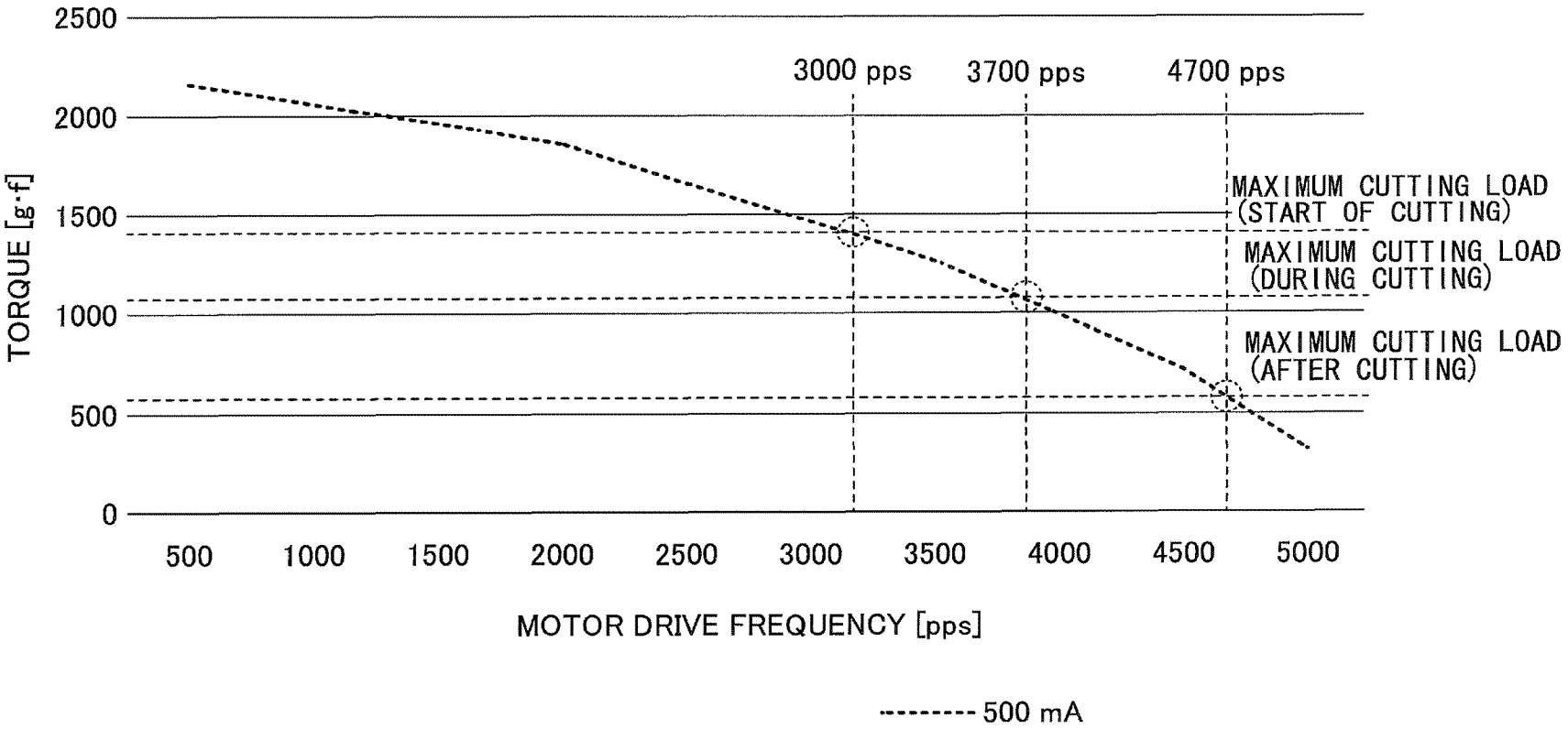
FIG. 13 is a graph illustrating a relationship between a motor drive frequency and torque of a drive motor.

FIG. 13 is a graph illustrating a relationship between the motor drive frequency and torque when the drive current is set at 500 mA. To obtain torque of 1,400 g·f or greater, the drive motor 13 is driven at a motor drive frequency of 3000 pps. To obtain torque of 1,100 g·f or greater, the drive motor 13 is driven at a motor drive frequency of 3,700 pps. To obtain torque of 550 g·f or greater, the drive motor 13 is driven at a motor drive frequency of 4,700 pps.

Here, normally, a certain period of time is necessary before the process proceeds from step S306 to step S308. Therefore, if the initial stage is not completed before driving the drive motor 13 with the conditions set at step S308, a time lag may be set between step S306 and step S308.

Next, at step S310, the motor controller 26 determines whether the movable blade 12 is detectable by the third position sensor 33. When the movable blade 12 is detectable by the third position sensor 33, the motor controller 26 repeats step S310. When the movable blade 12 is undetectable by the third position sensor 33, the motor controller 26 proceeds to step S312. The case where the movable blade 12 is undetectable by the third position sensor 33 corresponds to a state illustrated by FIG. 6C where the cutting of the medium 50 has been completed.

At step S312, the motor controller 26 sets the motor drive frequency at 4,700 pps and sets the electric current at 500 mA. As a result, the torque of the drive motor 13 further decreases but the rotational speed of the drive motor 13 further increases. This makes it possible to move the movable blade 12 at a higher speed. At step S312, the conditions for driving the drive motor are set at the above described values to obtain torque corresponding to a cutting load of 550 g·f illustrated in FIG. 1. More specifically, these conditions are determined based on the graph of FIG. 13.

At step S314, the motor controller 26 rotates the drive motor 13 in a reverse direction with the conditions set at step S312. More specifically, the motor controller 26 rotates the drive motor 13 in the reverse direction at the motor drive frequency of 4,700 pps and with the drive current of 500 mA. As a result, the movable blade 12 moves away from the fixed blade 11.

At step S316, the motor controller 26 determines whether the movable blade 12 is detectable by the first position sensor 31. When the movable blade 12 is undetectable by the first position sensor 31, the motor controller 26 repeats step S316. When the movable blade 12 is detectable by the first position sensor 31, the motor controller 26 proceeds to step S318. When the movable blade 12 is detectable by the first position sensor 31, the movable blade 12 is at the home position as illustrated by FIG. 7B.

At step S318, the motor controller 26 stops the rotation of the drive motor 13 to end the process of controlling the cutter of the present embodiment.

Other details of the method of the second embodiment not described above are substantially the same as those of the first embodiment.

«Fourth Embodiment»

Figure 14:
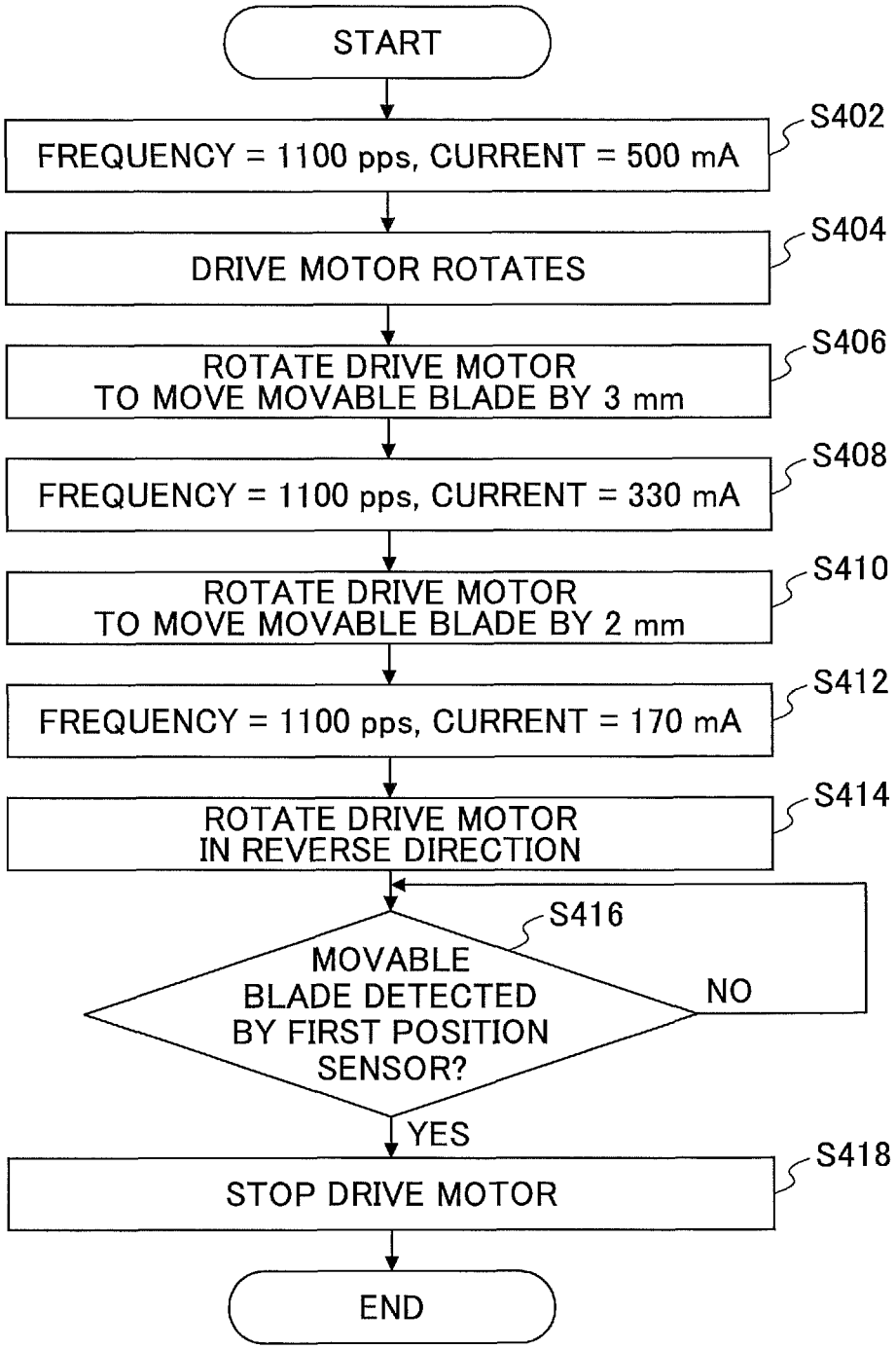
FIG. 14 is a flowchart illustrating a method of controlling a cutter according to a fourth embodiment.

Next, a fourth embodiment is described. In the fourth embodiment, the cutter is controlled by controlling the drive current supplied to the drive motor 13 while maintaining the motor drive frequency for driving the drive motor 13 at a constant value. An exemplary method of controlling the cutter according to the present embodiment is described with reference to FIG. 14. In the fourth embodiment, the position of the movable blade 12 is determined based on the distance that the movable blade 12 has moved. Therefore, only the first position sensor 31 is used to detect the position of the movable blade 12.

At step S402, the motor controller 26 sets the motor drive frequency at 1,100 pps and sets the drive current at 500 mA to drive the drive motor 13. As a result, at step S404, the drive motor 13 rotates and the movable blade 12 slides toward the fixed blade 11.

Before the drive motor 13 rotates, the movable blade 12 is detectable by the first position sensor 31. After that, the movable blade 12 moves toward the fixed blade 11 and becomes undetectable by the first position sensor 31.

At step S402, the conditions for driving the drive motor 13 are set at the above described values to obtain torque greater than or equal to 1,400 g·f by the drive motor 13. These conditions are determined based on the graph of FIG. 11.

At step S406, the motor controller 26 rotates the drive motor 13 with the conditions set at step S402 to move the movable blade 12 by 3 mm. A distance of 3 mm corresponds to the distance that the movable blade 12 moves from the home position to a position where the initial stage of the cutting process ends. The moving distance of the movable blade 12 is determined by the movable-blade distance meter 22 by counting the number of pulses supplied to the drive motor 13 (pulse motor).

At step S408, the motor controller 26 sets the motor drive frequency at 1,100 pps and sets the drive current at 330 mA to drive the drive motor 13. As a result, the torque of the drive motor 13 decreases and the power consumption of the drive motor 13 also decreases. At step S408, the conditions for driving the drive motor 13 are set at the above described values to obtain torque greater than or equal to 1,100 g·f. More specifically, these conditions are determined based on the graph of FIG. 11.

At step S410, the motor controller 26 rotates the drive motor 13 with the conditions set at step S408 to move the movable blade 12 by 2 mm. As a result, the movable blade 12 moves to a position corresponding to 5 mm in FIG. 1, i.e., to a position where the cutting process ends.

At step S412, the motor controller 26 sets the motor drive frequency at 1,100 pps and sets the drive current at 170 mA. As a result, the torque of the drive motor 13 further decreases and the power consumption of the drive motor 13 also further decreases. At step S412, the conditions for driving the drive motor 13 are set at the above described values to obtain torque corresponding to a cutting load of 550 g·f illustrated in FIG. 1. More specifically, these conditions are determined based on the graph of FIG. 11.

At step S414, the motor controller 26 rotates the drive motor 13 with the conditions set at step S412. More specifically, the motor controller 26 controls the drive motor 13 to move the movable blade 12 by 1 mm toward the fixed blade 11 so that the movable blade 12 reaches a position that is 6 mm from the home position. Then, the motor controller 26 rotates the drive motor 13 in the reverse direction to move the movable blade 12 away from the fixed blade 11 up to the home position.

At step S416, the motor controller 26 determines whether the movable blade 12 is detectable by the first position sensor 31. When the movable blade 12 is undetectable by the first position sensor 31, the motor controller 26 repeats step S416. When the movable blade 12 is detectable by the first position sensor 31, the motor controller 26 proceeds to step S418.

At step S418, the motor controller 26 stops the rotation of the drive motor 13 to end the process of controlling the cutter of the present embodiment.

Other details of the method of the fourth embodiment not described above are substantially the same as those of the second embodiment.

«Fifth Embodiment»

Figure 15:
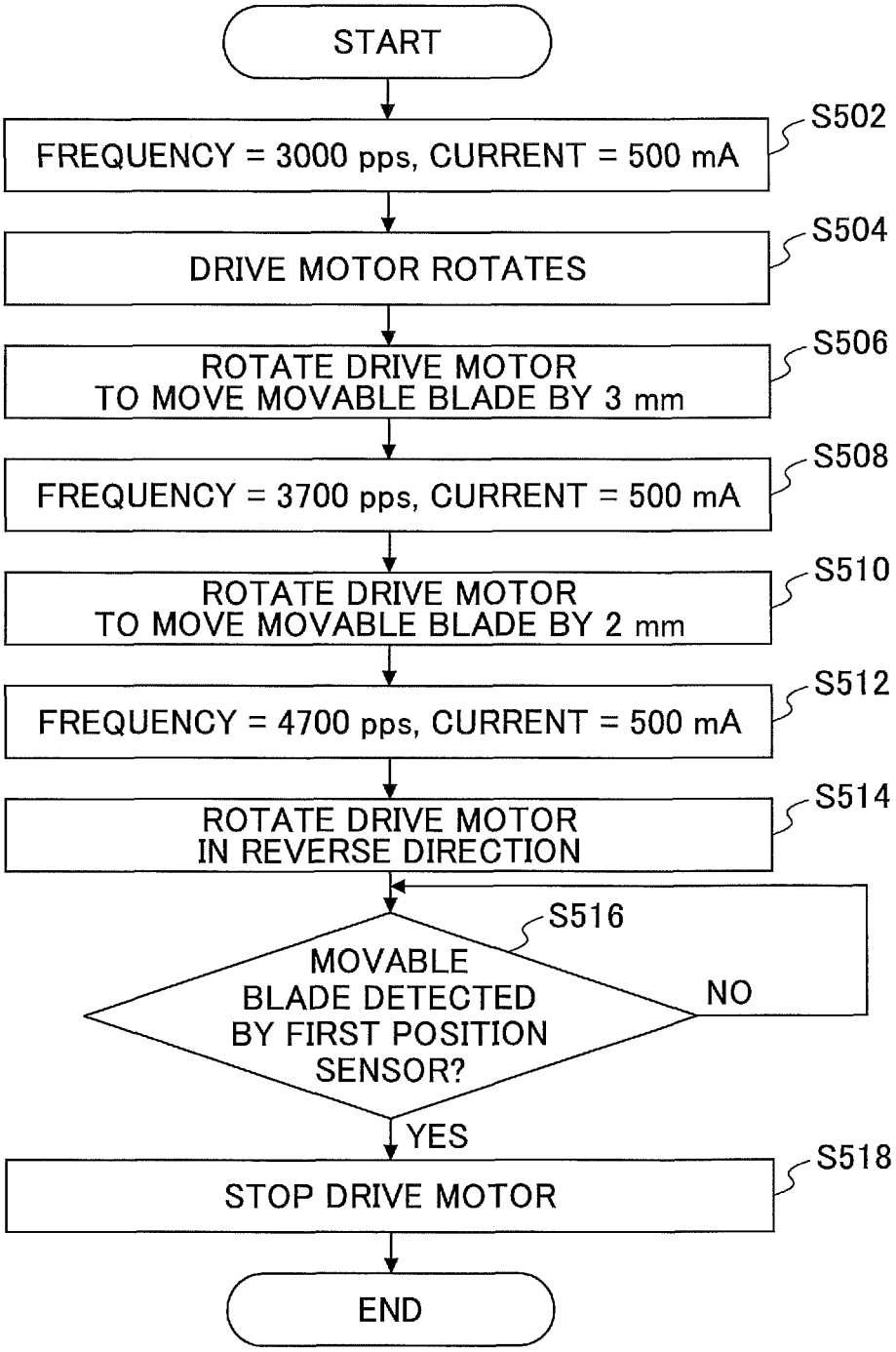
FIG. 15 is a flowchart illustrating a method of controlling a cutter according to a fifth embodiment.

Next, a fifth embodiment is described. In the fifth embodiment, the cutter is controlled by controlling the motor drive frequency for driving the drive motor 13 while maintaining the drive current supplied to the drive motor 13 at a constant value. An exemplary method of controlling the cutter according to the present embodiment is described with reference to FIG. 15. In the present embodiment, similarly to the fourth embodiment, only the first position sensor 31 is used to detect the position of the movable blade 12.

At step S502, the motor controller 26 sets the motor drive frequency at 3,000 pps and sets the drive current at 500 mA to drive the drive motor 13. As a result, at step S504, the drive motor 13 rotates and the movable blade 12 slides toward the fixed blade 11.

When the movable blade 12 moves toward the fixed blade 11, the movable blade 12 becomes undetectable by the first position sensor 31. At step S502, the conditions for driving the drive motor 13 are set at the above described values to obtain torque corresponding to 1,400 g·f by the drive motor 13. These conditions are determined based on the graph of FIG. 13.

At step S506, the motor controller 26 rotates the drive motor 13 with the conditions set at step S502 to move the movable blade 12 by 3 mm.

At step S508, the motor controller 26 sets the motor drive frequency at 3,700 pps and sets the drive current at 550 mA. As a result, the torque of the drive motor 13 decreases but the rotational speed of the drive motor 13 increases. This makes it possible to move the movable blade 12 at a higher speed. Specifically, the torque of the drive motor 13 decreases to 1,100 g·f.

At step S510, the motor controller 26 rotates the drive motor 13 with the conditions set at step S508 to move the movable blade 12 by 2 mm.

At step S512, the motor controller 26 sets the motor drive frequency at 4,700 pps and sets the electric current at 500 mA. As a result, the torque of the drive motor 13 further decreases and the power consumption of the drive motor 13 also further decreases. Specifically, the torque of the drive motor 13 decreases to 550 g·f.

At step S514, the motor controller 26 rotates the drive motor 13 with the conditions set at step S512. More specifically, the motor controller 26 controls the drive motor 13 to move the movable blade 12 by 1 mm toward the fixed blade 11, and then rotates the drive motor 13 in the reverse direction to move the movable blade 12 away from the fixed blade 11 up to the home position.

At step S516, the motor controller 26 determines whether the movable blade 12 is detectable by the first position sensor 31. When the movable blade 12 is undetectable by the first position sensor 31, the motor controller 26 repeats step S516. When the movable blade 12 is detectable by the first position sensor 31, the motor controller 26 proceeds to step S518.

At step S518, the motor controller 26 stops the rotation of the drive motor 13 to end the process of controlling the cutter of the present embodiment.

Other details of the method of the fifth embodiment not described above are substantially the same as those of the third embodiment.

«Sixth Embodiment»

Next, a sixth embodiment is described. In the sixth embodiment, driving modes of the drive motor 13 are changed according to the position of the movable blade 12. Driving modes for driving a stepping motor used as the drive motor 13 include a 2-phase driving mode, an 1-2 phase driving mode, and a micro-step driving mode. Also, the micro-step driving mode includes a W1-2 phase driving mode and a 2W1-2 phase driving mode. The drive motor 13 of the cutter of the present embodiment can be driven in the above driving modes.

The different driving modes have different characteristics. The electric current necessary to drive a stepping motor decreases in the order of the 2-phase drive mod, the 1-2 phase driving mode, and the micro-step driving mode. For this reason, the torque, the vibration, and the noise of a stepping motor also decrease in the noted order. That is, in terms of torque, the relationship among the driving modes is expressed by a formula "2-phase driving mode>1-2 phase driving mode>micro-step driving mode". Also, in terms of noise (vibration), the relationship among the driving modes is expressed by a formula "2-phase driving mode>1-2 phase driving mode>micro-step driving mode". Accordingly, it is possible to reduce the noise generated by the drive motor 13 by driving the drive motor 13 in the 2-phase driving mode while the medium 50 is being cut and by driving the drive motor in the micro-step driving mode while the medium 50 is not being cut.

The number of steps for achieving the same angle of rotation of the stepping motor is, one in the 2-phase driving mode, two in the 1-2 phase driving mode, and four in the micro-step driving mode. Accordingly, the rotational speed of the drive motor 13, i.e., the moving speed of the movable blade 12, is the same when the motor drive frequency in the 2-phase driving mode is 1,000 pps, when the motor drive frequency in the 1-2 phase driving mode is 2,000 pps, and when the motor drive frequency in the micro-step driving mode is 4,000 pps.

Figure 16:
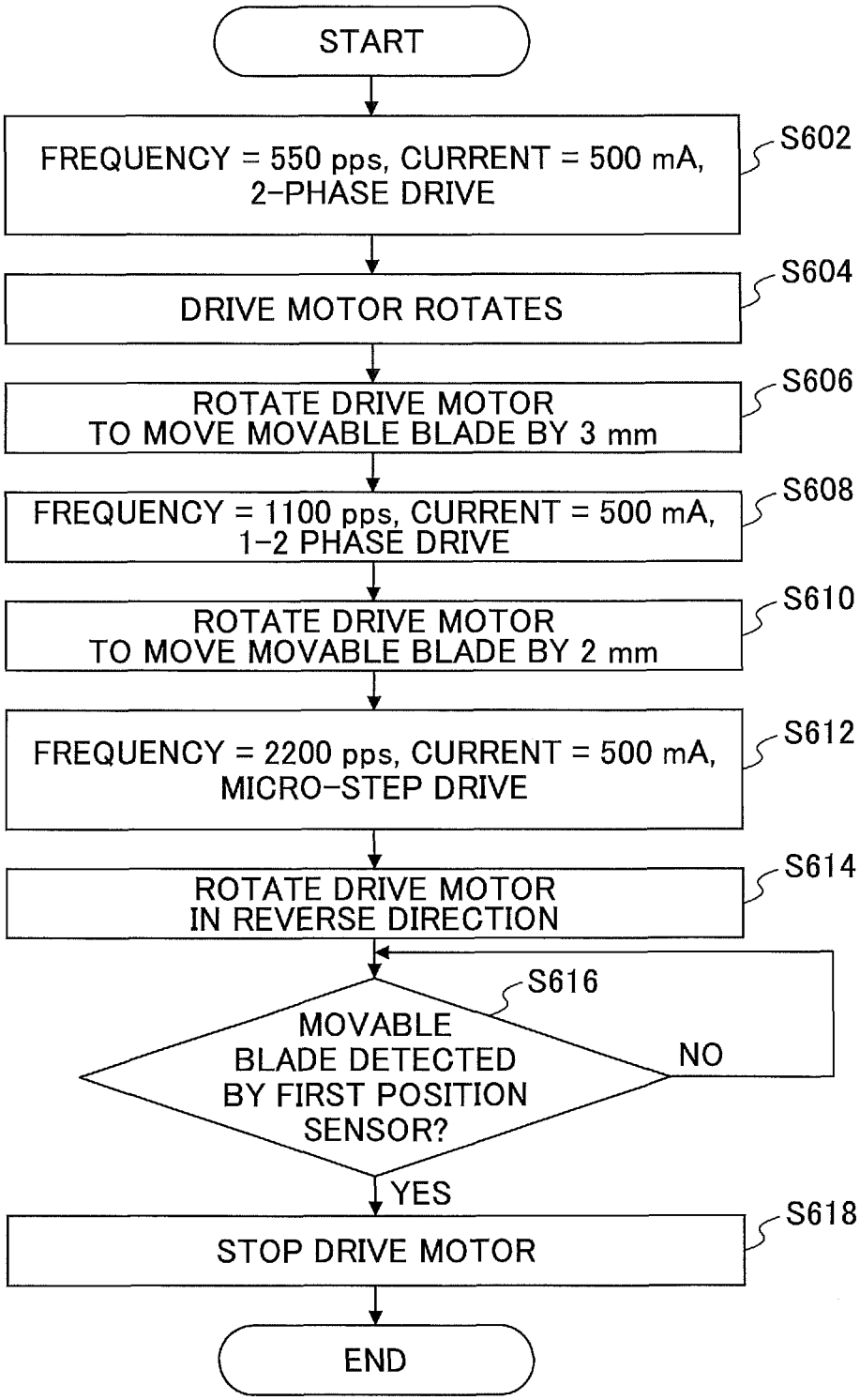
FIG. 16 is a flowchart illustrating a method of controlling a cutter according to a sixth embodiment.

Next, an exemplary method of controlling the cutter according to the present embodiment is described with reference to FIG. 16. In the present embodiment, similarly to the fourth embodiment, only the first position sensor 31 is used to detect the position of the movable blade 12. However, the first through third position sensors 31-33 may instead be used as in the second embodiment.

At step S602, the motor controller 26 sets the 2-phase driving mode as the driving mode of the drive motor 13, sets the motor drive frequency at 550 pps, and sets the drive current at 500 mA. As a result, at step S604, the drive motor 13 rotates and the movable blade 12 slides toward the fixed blade 11.

When the movable blade 12 moves toward the fixed blade 11, the movable blade 12 becomes undetectable by the first position sensor 31.

At step S606, the motor controller 26 rotates the drive motor 13 with the conditions set at step S602 to move the movable blade 12 by 3 mm.

At step S608, the motor controller 26 sets the 1-2 phase driving mode as the driving mode of the drive motor 13, sets the motor drive frequency at 1,100 pps, and sets the drive current at 500 mA.

At step S610, the motor controller 26 rotates the drive motor 13 with the conditions set at step S608 to move the movable blade 12 by 2 mm.

At step S612, the motor controller 26 sets the micro-step driving mode as the driving mode of the drive motor 13, sets the motor drive frequency at 2,200 pps, and sets the drive current at 500 mA.

At step S614, the motor controller 26 rotates the drive motor 13 with the conditions set at step S612. More specifically, the motor controller 26 controls the drive motor 13 to move the movable blade 12 by 1 mm toward the fixed blade 11, and then rotates the drive motor 13 in the reverse direction to move the movable blade 12 away from the fixed blade 11 up to the home position.

At step S616, the motor controller 26 determines whether the movable blade 12 is detectable by the first position sensor 31. When the movable blade 12 is undetectable by the first position sensor 31, the motor controller 26 repeats step S616. When the movable blade 12 is detectable by the first position sensor 31, the motor controller 26 proceeds to step S618.

At step S218, the motor controller 26 stops the rotation of the drive motor 13 to end the process of controlling the cutter of the present embodiment.

An aspect of this disclosure makes it possible to reduce the power for driving a cutter, and also makes it possible to reduce a cutting time as well as a cutting load.

A cutter and methods for controlling the cutter according to embodiments of the present invention are described above. However, the present invention is not limited to the specifically disclosed embodiments, and variations and modifications may be made without departing from the scope of the present invention.

What is claimed is:

1. A cutter, comprising:
a fixed blade;
a movable blade;
a drive motor that moves the movable blade;
at least one sensor; and
a controller that drives the drive motor to move the movable blade toward the fixed blade and to perform a process for cutting a medium, wherein
the process includes a first moving process for moving the movable blade from a home position to a contact position at which the movable blade contacts the medium, a cutting process for moving the movable blade from the contact position to a cutting end position at which cutting of the medium ends, and a second moving process for moving the movable blade from the cutting end position to the home position;
the sensor is configured to detect multiple positions of the movable blade during the process; and
the controller is configured to drive the drive motor based on the positions of the movable blade detected by the sensor such that output torque of the drive motor output while the movable blade is in the first moving process and the second moving process becomes lower than the output torque of the drive motor output while the movable blade is in the cutting process.

2. The cutter as claimed in claim 1, wherein
the cutting process includes an initial stage where the movable blade is moved from the contact position to an initial stage end position that is at a predetermined distance from the contact position and a later stage where the movable blade is moved from the initial stage end position to the cutting end position; and
the controller drives the drive motor such that the output torque in the later stage becomes lower than the output torque in the initial stage.

3. The cutter as claimed in claim 1, wherein the controller changes the output torque of the drive motor by changing an electric current supplied to the drive motor.

4. The cutter as claimed in claim 1, wherein
the drive motor is a stepping motor; and
the controller changes the output torque by changing a frequency supplied to the stepping motor.

5. The cutter as claimed in claim 1, wherein
the drive motor is a stepping motor that supports plural driving modes; and
the controller changes the output torque by changing the driving modes of the stepping motor according to the positions of the movable blade.

6. The cutter as claimed in claim 1, wherein the at least one sensor includes
a first sensor that detects whether the movable blade is at the home position,
a second sensor that detects whether the movable blade is at the contact position, and
a third sensor that detects whether the movable blade is at the cutting end position.

7. A printer, comprising:
the cutter of claim 1;
a print head that prints information on the medium; and
a platen roller.

8. A cutter, comprising:
a fixed blade;
a movable blade;
a drive motor that moves the movable blade;
a sensor; and
a controller that drives the drive motor to move the movable blade toward the fixed blade and to perform a process for cutting a medium, wherein
the process includes a first moving process where the movable blade is moved from a home position to a contact position at which the movable blade contacts the medium, a cutting process where the movable blade is moved from the contact position to cut the medium, and a second moving process where the movable blade is moved to the home position after the cutting process;
the sensor is configured to detect multiple positions of the movable blade during the process; and
the controller is configured to drive the drive motor based on the positions of the movable blade detected by the sensor such that output torque of the drive motor output while the movable blade is in the first moving process and the second moving process becomes lower than the output torque of the drive motor output while the movable blade is in the cutting process.

9. A cutter, comprising:
a fixed blade;
a movable blade;
a drive motor that moves the movable blade;
a sensor; and
a controller that drives the drive motor to move the movable blade toward the fixed blade and to perform a process for cutting a medium, wherein
the process includes a first moving process where the movable blade is moved from a home position to a contact position at which the movable blade contacts the medium, a cutting process where the movable blade is moved from the contact position to cut the medium, and a second moving process where the movable blade is moved to the home position after the cutting process;
the cutting process includes an initial stage where the movable blade is moved from the contact position to an initial stage end position that is at a predetermined distance from the contact position and a later stage where the movable blade is moved from the initial stage end position to a cutting end position at which cutting of the medium ends;

the sensor is configured to detect multiple positions of the movable blade during the process; and the controller is configured to drive the drive motor at a first torque while the movable blade is in the initial stage, at a second torque lower than the first torque while the movable blade is in the later stage, and at a third torque lower than the second torque while the movable blade is in the second moving process, based on the positions of the movable blade detected by the sensor.

* * * * *